US007456589B2

(12) United States Patent
Sun et al.

(10) Patent No.: US 7,456,589 B2
(45) Date of Patent: Nov. 25, 2008

(54) LIGHT OUTPUT MODULATION FOR DATA TRANSMISSION

(75) Inventors: Xiaohong Sun, Briarcliff Manor, NY (US); Demetri J. Giannopoulos, Norwalk, CT (US); Laurence Bourdillon, New Milford, CT (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 533 days.

(21) Appl. No.: 10/560,010

(22) PCT Filed: Jun. 3, 2004

(86) PCT No.: PCT/IB2004/001842

§ 371 (c)(1),
(2), (4) Date: Dec. 8, 2005

(87) PCT Pub. No.: WO2004/110109

PCT Pub. Date: Dec. 16, 2004

(65) Prior Publication Data

US 2007/0057639 A1 Mar. 15, 2007

Related U.S. Application Data

(60) Provisional application No. 60/477,221, filed on Jun. 10, 2003.

(51) Int. Cl.
*G05F 1/00* (2006.01)
*H05B 39/04* (2006.01)

(52) U.S. Cl. ..... 315/307; 315/291

(58) Field of Classification Search ..... 315/291, 315/307, 194, 294, DIG. 4
See application file for complete search history.

(56) References Cited

U.S. PATENT DOCUMENTS

| | | | | |
|---|---|---|---|---|
| 6,191,563 | B1 * | 2/2001 | Bangerter | 323/211 |
| 6,333,605 | B1 * | 12/2001 | Grouev et al. | 315/291 |
| 6,388,398 | B1 * | 5/2002 | Li et al. | 315/307 |
| 6,498,441 | B1 * | 12/2002 | Shen | 315/291 |
| 6,639,368 | B2 * | 10/2003 | Sheoghong | 315/291 |

* cited by examiner

*Primary Examiner*—David Hung Vu
*Assistant Examiner*—Minh Dieu A

(57) ABSTRACT

A method of operating a light source (100) including a ballast (110) in electrical communication with a lamp (120). The method includes operating the ballast (110) to determine (920) an average lamp power to be applied to the lamp (120) during a data period. The method further includes operating the ballast (110) to generate and communicate (930) a pulse width modulated drive signal to the lamp (120) during the data period, the pulse width modulated drive signal having one of a first waveform and a second waveform for applying the average lamp power to the lamp (120), the first waveform including at least one pulse representative of a first data bit, the second waveform including at least one pulse representative of a second data bit. The method additionally includes operating the lamp (120) to emit (940) a modulated light output in response to a reception of the pulse width modulated drive signal during the data period, the modulated light output being representative of the first data bit in response to the pulse width modulated drive signal having the first waveform, the modulated light output being representative of the second data bit in response to the pulse width modulated drive signal having the second waveform.

15 Claims, 6 Drawing Sheets

LIGHT OUTPUT MODULATION FOR DATA TRANSMISSION

CROSS REFERENCE TO RELATED APPLICATION

This application claims the benefit of U.S. provisional application Ser. No. 60/477,221, filed Jun. 10, 2003, which the entire subject matter is incorporated herein by reference.

In general, the invention relates to light source data transmission. More specifically, the invention relates to a method and system for transmitting data utilizing a fluorescent light source and light output modulation.

Most artificial light is produced utilizing a lamp in which an electric discharge through a gas is used to produce illumination. One such lamp is the fluorescent lamp. The prevalence of electric discharge illumination has lead to the utilization of discharge lamps for data transmission via light output modulation, such as, for example, dimming control applications.

Early in the development of discharge lamps for data transmission applications, an analog amplitude modulation (AM) scheme was utilized to modulate the arc current in a fluorescent lamp, the "carrier" signal, with an audio information signal. Unfortunately, this technique and similar techniques are undesirable for the direct transmission for a number of reasons, such as, for example low frequency content in the data that may lead to perceptible flicker in the light output.

Later development of discharge lamps for data transmission applications included a frequency modulation (FM) scheme that was utilized to transmit data using light output modulation. The FM method utilizes frequency variation to regulate the light output of a fluorescent lamp over a dimming range and requires a large, continuous frequency range.

Unfortunately, there are frequency values where operation of a high-frequency lamp driver is not desirable. For example, operating frequencies above the audible range include at least two frequency ranges that should not be utilized. One frequency range example is the RC-5 frequency range (30-42 kHz), utilized for infrared remote control. Lamps operating in this frequency range can interfere with the operation of the RC-5 remote control receivers.

Another frequency range example is the anti-theft protection gate frequency range (56-60 kHz), utilized in U.S. retail establishments. In some instances, the EM field generated by the ballast of the fluorescent lamp can disturb the proper operation of the anti-theft protection gates. Since the frequency range of the ballast operation is continuous, the ballast should operate either above or below these frequency ranges.

One solution has been to limit the ballast operation to frequency values above the undesirable frequency ranges. Unfortunately, the operating frequency needs to be as low as possible to achieve favorable dimming performance. Additionally, at high frequency values and low dimming levels current flowing through the parasitic wiring capacitance becomes more critical an interference factor to the regulation of the lamp current.

Another problem associated with frequency variation is that light output regulation, using frequency variation, is not suitable for multi-lamp type ballasts. Ballast lamp stability characteristics are a complex function of the relative values of the ballast output impedance and the lamp impedance. The ballast output impedance will vary with frequency and the lamp impedance will vary non-linearly with power dissipation. For this reason, with a fixed-ballast design, full dimming using frequency variation is generally achieved only for a limited number of lamp types. For other lamp-ballast combinations, dimming will not be possible over the entire range and therefore not commercially viable.

Recently, pulse-width modulation (PWM) based control methods have been utilized to address the frequency range problems. Pulse-width modulation (PWM) based control methods, which use a fixed frequency of operation, offer advantages and can be applied in multi-lamp type ballasts. PWM based control methods are implemented using either a digital ballast or an analog ballast. Therefore, PWM can be implemented utilizing a fixed frequency outside the undesirable frequency ranges.

Unfortunately, implementation of digital ballasts has been restricted primarily to control aspects, such as, for example dimming applications. Furthermore, utilizing digital ballasts that use PWM based control methods for communication applications has proven to be a complex undertaking. Utilizing digital ballasts that use conventional coding of PWM based control methods for communication applications may result in flickering that is noticeable to the human eye.

One form of the invention is a method operating a light source including a ballast in electrical communication with a lamp. First, the ballast determines an average lamp power to be applied to the lamp during a data period, and communicates a generated pulse width modulated drive signal to the lamp during the data period. The pulse width modulated drive signal has either one of a first waveform or a second waveform for applying the average lamp power to the lamp during the data period. The first waveform includes one or more pulses representative of a first data bit, and the second waveform includes one or more pulses representative of a second data bit. Second, the lamp emits a modulated light output during the data period in response to receiving the pulse width modulated driver signal. The modulated light output is either representative of the first data bit in response to the pulse width modulated drive signal having the first waveform or representative of the second data bit in response to the pulse width modulated drive signal having the second waveform.

Another form of the invention is an apparatus including a lamp and a ballast in electrical communication with the lamp. The ballast is operable to determine an average lamp power to be applied to the lamp during a first data period. The ballast is further operable to generate and communicate a pulse width modulated (PWM) drive signal to the lamp during the data period. The PWM drive signal includes either a first waveform or a second waveform for applying the average lamp power to the lamp. The first waveform includes one or more pulses representative of a first data bit, and the second waveform includes one or more pulses representative of a second data bit. The lamp is operable to emit a modulated light output responsive to a reception of the PWM drive signal during the data period. The modulated light output is representative of the first data bit in response to the PWM drive signal having the first waveform, and the modulated light output is representative of the second data bit in response to the PWM drive signal having the second waveform.

The foregoing form and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

Figure 1:
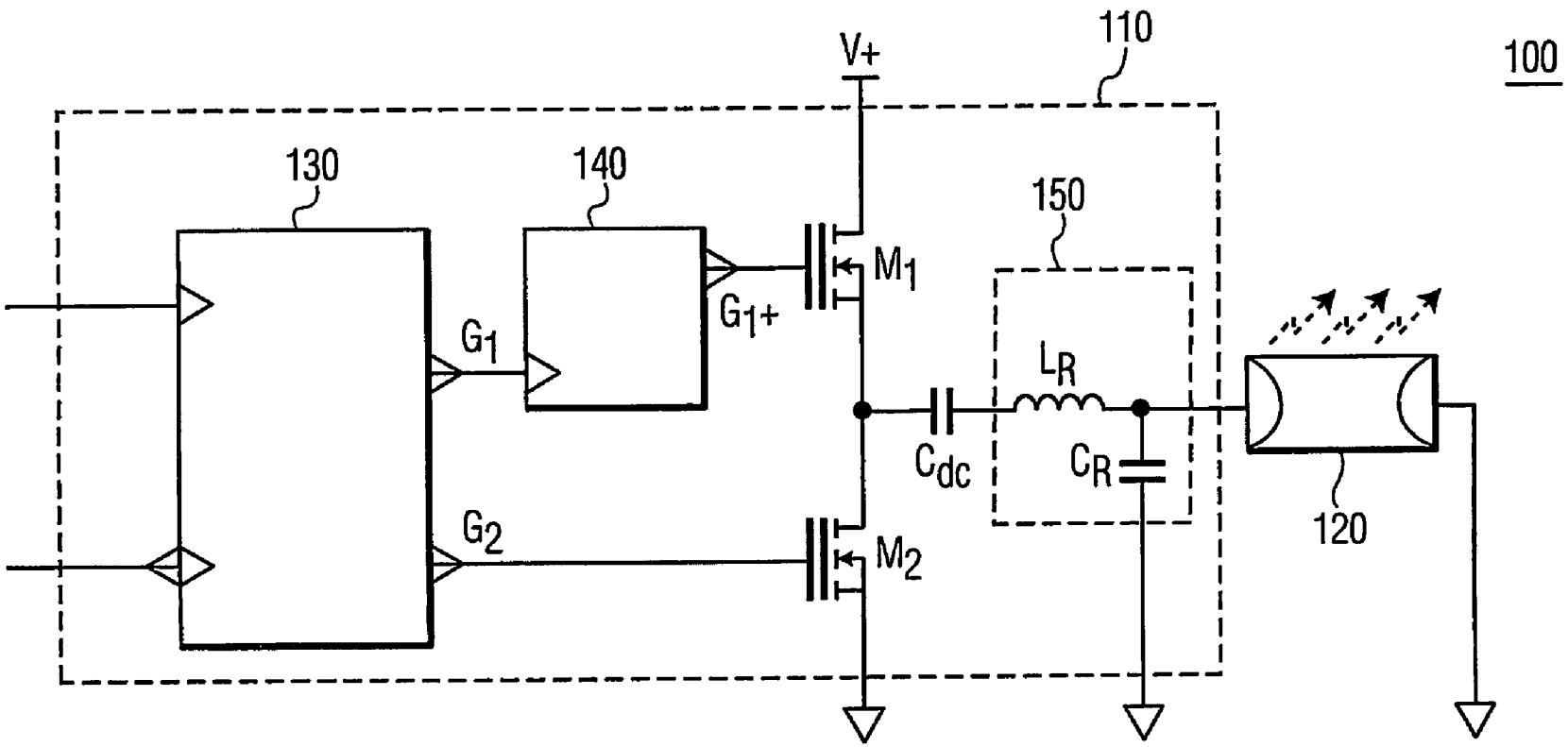
FIG. 1 is a schematic diagram illustrating a programmable digital ballast, within a light source, in accordance with one embodiment of the present invention.

FIG. 1 is a schematic diagram illustrating a programmable digital ballast within a light source 100 in accordance with one embodiment of the present invention. Light source 100 transmits data via light output modulation. Light source 100 includes programmable digital ballast 110 and lamp 120. Light source 100 includes a communication transceiver interface imbedded (not shown) within programmable digital ballast 110 for receiving data for transmission as well as control functions.

In FIG. 1, programmable digital ballast 110 includes a microprocessor 130, level shifter 140, resonance tank 150, transistors ($M_1$ and $M_2$), and capacitor $C_{dc}$. Programmable digital ballast 110 is arranged in a half-bridge driver configuration and produces a non-overlapping driving signal based on the configuration.

Microprocessor 130 includes a data signal input terminal (Data), a control signal input/output terminal CTL, a first output signal terminal $G_1$, and a second output signal terminal $G_2$. In another embodiment, the functionality of data signal input terminal (Data) and control signal input terminal CTL of microprocessor 130 are performed by a single signal input/output terminal. Level shifter 140 includes a first input signal terminal $G_1$ and a first output signal shifted terminal $G_{1+}$. The first input signal terminal $G_1$ of level shifter 140 is coupled to first output signal terminal $G_1$ of microprocessor 130.

Transistors $M_1$ and $M_2$ are field effect transistors (FETs), each having a source, a gate, and a drain. The source of transistor $M_1$ is coupled to a voltage source $V_+$ and the gate of transistor $M_1$ is coupled to the first output signal shifted terminal $G_{1+}$. The source of transistor $M_2$ is coupled to the drain of transistor $M_1$. The gate of transistor $M_2$ is coupled to second output signal terminal $G_2$ and the drain of transistor $M_2$ is coupled to a circuit ground GND.

Capacitor $C_{dc}$ includes a first terminal and a second terminal. The first terminal of capacitor $C_{dc}$ is coupled to the drain of transistor $M_1$ and the source of transistor $M_2$. Resonance tank 150 includes an inductor $L_R$ and a capacitor $C_R$. Inductor $L_R$ of resonance tank 150 includes a first terminal and a second terminal. The first terminal of inductor $L_R$ is coupled to the second terminal of capacitor $C_{dc}$. Capacitor $C_R$ of resonance tank 150 includes a first terminal and a second terminal. The first terminal of capacitor $C_R$ is coupled to the second terminal of inductor $L_R$. The second terminal of capacitor $C_R$ is coupled to a circuit ground GND.

Lamp 120 includes a first terminal and a second terminal. The first terminal of lamp 120 is coupled to the second terminal of inductor $L_R$ and the first terminal of capacitor $C_R$. The second terminal of lamp 120 is coupled to ground GND.

In operation, microprocessor 130 receives a control signal at the control signal input terminal CTL and an input data signal at the data signal input terminal Data. The control signal includes a light source output level instruction. In one embodiment, the light source output level instruction is a user determined light source output level instruction based on a user determined light output level. The input data signal includes input data in the form of communication data or fixed code for maintaining the user determined light output level.

Microprocessor 130 produces gate drive signals based on the received control signal and input data signal. The control signal is utilized to determine a duty cycle (detailed in FIG. 2, below). Methodology for producing the aforementioned duty cycle is well known in the art.

The determined duty cycle and the input data signal are utilized to produce two pulse width modulated gate drive signals that result in turn a pulse width modulated tank drive signal as described below. In one embodiment, the gate drive signals are bi-phase signals (detailed in FIG. 2, below). Bi-phase signals eliminate flickering. In another embodiment, the gate drive signals are generated utilizing pulse width modulation without bi-phase coding.

A first gate drive signal is transmitted from first output signal terminal $G_1$ of microprocessor 130 to first input signal terminal $G_1$ of level shifter 140. Level shifter 140 shifts the first gate drive signal and produces a shifted first gate drive signal at first output signal shifted terminal $G_{1+}$. The shifted first gate drive signal is transmitted from first output signal shifted terminal $G_{1+}$ to the gate of transistor $M_2$. In one embodiment, the first gate drive signal is shifted by increasing the signal so that the shifted first gate drive signal will be large enough to affect the gate of transistor $M_1$ relative to the voltage applied to the source of transistor $M_1$ by voltage source $V_+$. A second gate drive signal is transmitted from second output signal terminal $G_2$ of microprocessor 130 to the gate of transistor $M_2$.

The shifted first gate drive signal and the second gate drive signal drive the associated transistors ($M_1$ and $M_2$) and produce the pulse width modulated signal drive signal at the first terminal of capacitor $C_{dc}$. Capacitor $C_{dc}$ filters and removes low frequency (direct current) portions of the pulse width modulated signal drive signal. The filtered pulse width modulated drive signal is then applied to resonance tank 150.

In a PWM driving scheme, increasing the duty cycle of the driving signal will increase the power transferred to the lamp, thus increasing the lamp light output.

Resonance tank 150 is a frequency dependant circuit. The impedance of both the inductor $L_R$ and capacitor $C_R$ change as the frequency of the pulse width modulated drive signal changes. In one embodiment, resonance tank 150 receives the pulse width modulated tank drive signal and delivers a power signal to the lamp based on the pulse width modulated tank drive signal. For example, at a high frequency, the impedance of resonance tank 150 is large and therefore the power delivered to lamp 120 is low. Conversely, at a low frequency, the impedance of resonance tank 150 is low and therefore the power delivered to lamp 120 is high.

The power delivered to lamp 120 causes the intensity of the lamp to change at a very high rate for varying lengths of time. This rate is referred to as the switching frequency of the half bridge within the digital ballast. If the switching frequency is maintained at a high enough rate, it will not be visible to the human eye. In one embodiment, a switching frequency of greater than 30 kilohertz is utilized and will insure that visible flickering does not occur.

Light source 100 can be implemented as any suitable fluorescent light source including a programmable digital ballast, such as, for example the fluorescent light source including programmable digital ballast described in Circuit Arrangement as disclosed by Beij, Buij, Aendekerk, and Langeslag in WO 02/35893 published on May 2, 2002 and US2002/0093838 A1 published on Jul. 18, 2002.

In operation and detailed below, light source 100 receives a control signal that is based on a desired lamp/light output level. Microprocessor 130 of programmable digital ballast 110 determines an average lamp power to be applied to lamp 120 that is required to produce the desired average lamp/light output level. Programmable digital ballast 110 generates and communicates a pulse-width modulated (PWM) drive signal to lamp 120 based on the average lamp power determination. Generation of the PWM drive signal is described in FIGS. 2-8, below. Lamp 120 emits a modulated light output responsive to reception of the generated PWM drive signal.

Figure 2:
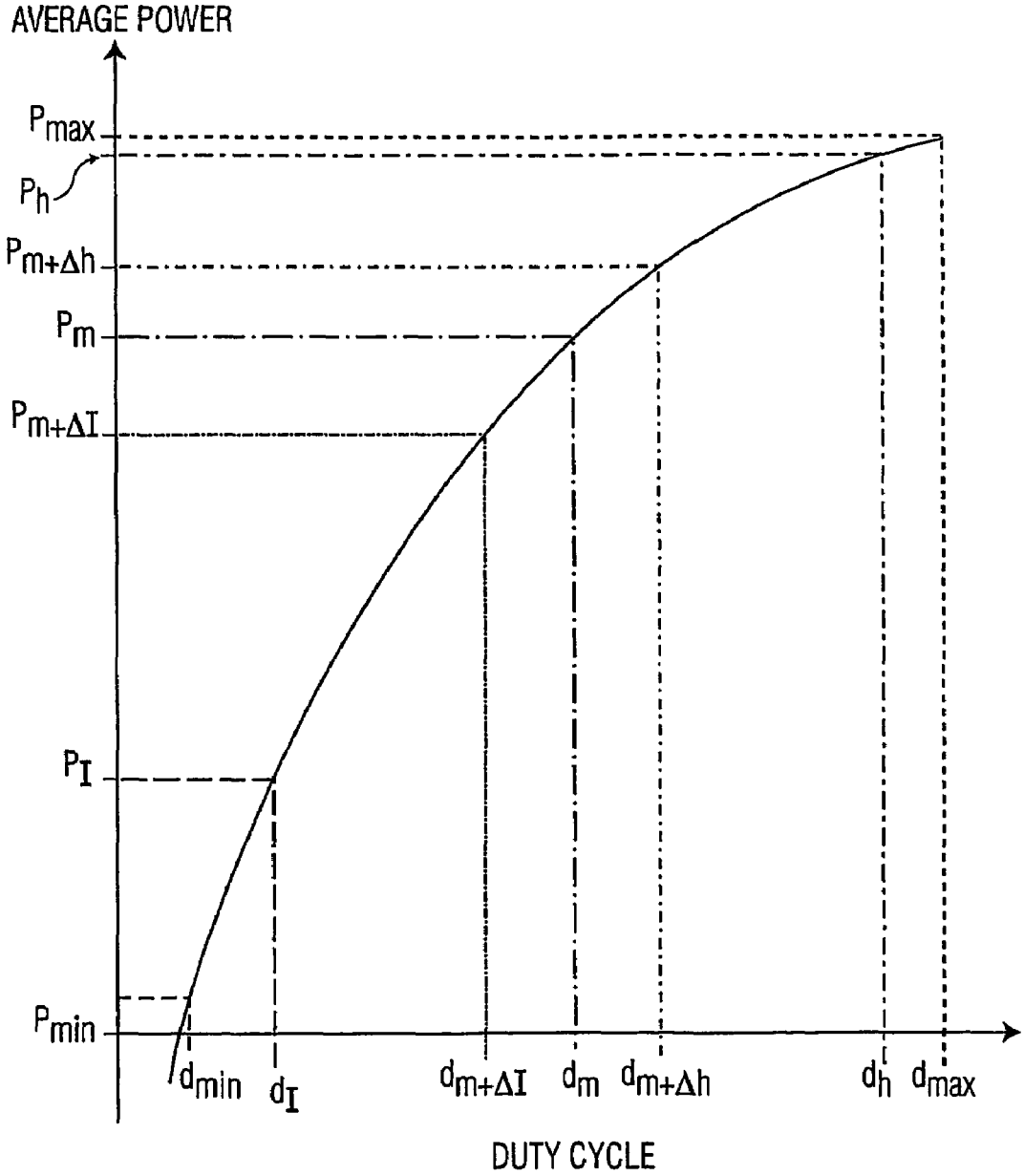
FIG. 2 is a graph illustrating a transfer curve defining the relationship of lamp power versus duty cycle for the lamp portion of the digital ballast in FIG. 1.

FIG. 2 is a graph, including an x-axis and a y-axis, illustrating a transfer curve defining the relationship of average lamp power versus duty cycle for the lamp portion of the digital ballast in FIG. 1. The transfer curve represents characteristics of a dimmable ballast that is utilized to drive a fluorescent lamp. In an example, the transfer curve represents characteristics of digital ballast 110 of FIG. 1.

In FIG. 2, average lamp power is illustrated as the y-axis and duty cycle is illustrated as the x-axis. For each average lamp power level identified on the y-axis, there is an associated duty cycle identified on the x-axis. The greater the amount of luminance required from the lamp, the greater the level of average lamp power along the y-axis. The x-axis is referred to as a duty cycle range. In one embodiment, the duty cycle is an expression of a percentage of time a lamp is producing light as compared to the amount of time within a predetermined period.

In FIG. 2, $P_{max}$ and $P_{min}$ represent the maximum and minimum rated power outputs of a fluorescent lamp. $d_{max}$ and $d_{min}$ represent the corresponding maximum and minimum duty cycles to achieve the respective average power levels. Because lamp power levels in a bi-phase PWM driving scheme are averages, the levels of maximum rated power output $P_{max}$ and minimum rated power outputs $P_{min}$ would be exceeded during a transmission by the peak-to-peak levels of the pulse width modulated drive signal. Therefore, a percentage of each level of maximum rated power output $P_{max}$ and minimum rated power outputs $P_{min}$ is identified as the maximum and minimum delivered average power level for the lamp associated with the transfer curve.

The maximum and minimum delivered average power levels are identified as $P_h$ and $P_l$ respectively. Determining factors for $P_h$ and $P_l$ include dimming range of the lamp and signal to noise ratio of the data transmission. In an example, maximum delivered average power level $P_h$ is ninety percent (90%) of the value of maximum rated power output $P_{max}$, and minimum delivered average power level $P_l$ is twenty percent (10%) of the value of maximum rated power output $P_{max}$. Each average power level has a corresponding duty cycle associated with it, $d_h$ and $d_l$ respectively. In one embodiment and referring to FIG. 1, transfer curve data for one or more fluorescent lamps is stored in a look-up table within microprocessor 130. In this embodiment, values for maximum delivered average power level $P_h$ and minimum delivered average power level $P_l$ representing the maximum and minimum delivered average power outputs of each fluorescent lamp model are stored within microprocessor 130 as well.

$P_m$ represents an average lamp power level associated with a lamp. The average lamp power level $P_m$ is a user defined level of luminance. $d_m$ represents a corresponding average duty cycle associated with the average lamp power level $P_m$. In one embodiment, the average duty cycle $d_m$ is determined by the feedback regulation loop in the lamp driver to set the average lamp power level $P_m$ to the level selected by the user.

$\Delta d_l$ and $\Delta d_h$ are design variables that are added to or subtracted from the average duty cycle $d_m$ to facilitate the detection of the light modulation by an optical receiver. The larger the difference between $\Delta d_l$ and $\Delta d_h$ levels, the more enhanced the detection of the light modulation by the optical receiver. Conversely, the greater the values of design variables ($\Delta d_l$ and $\Delta d_h$), the further maximum delivered average power level $P_h$ and minimum delivered average power level $P_l$ must be placed from maximum rated power output $P_{max}$ and minimum rated power output $P_{min}$.

Moving maximum delivered average power level $P_h$ and minimum delivered average power level $P_l$ away from maximum rated power output $P_{max}$ and minimum rated power output $P_{min}$ requires a corresponding movement of maximum average duty cycle $d_h$ and minimum average duty cycle $d_l$ away from maximum duty cycle $d_{max}$ and minimum duty cycle $d_{min}$. Moving maximum average duty cycle $d_h$ and minimum average duty cycle $d_l$ away from maximum duty cycle $d_{max}$ and minimum duty cycle $d_{min}$ results in a reduction of area for the range of the average duty cycle plus the design variable ($d_m+\Delta d_l$) and the average duty cycle plus the design variable ($d_m+\Delta d_h$) to occupy.

In one embodiment, design variables ($\Delta d_l$ and $\Delta d_h$) are provided by the software and stored within microprocessor 130, such as, for example in a look-up table. In another embodiment, design variables ($\Delta d_l$ and $\Delta d_h$) are provided by a lamp manufacturer and up-linked to microprocessor 130 for use when the lamp is installed.

In operation, when a user supplies a luminance level, for example a light/lamp output level, an average lamp output $P_m$ associated with the light/lamp output level and a corresponding average duty cycle $d_m$ are determined. In one embodiment, design variables ($\Delta d_l$ and $\Delta d_h$) are added to and subtracted from the average duty cycle $d_m$ to determine a duty cycle range [($d_m+\Delta d_l$) to ($d_m+\Delta d_h$)]. In an example, when the average duty cycle $d_m$ and the duty cycle range [($d_m+\Delta d_l$) to ($d_m+\Delta d_h$)] are within the center of the duty cycle spectrum, a symmetric bi-phase driving signal is produced. Such a symmetric bi-phase driving signal is illustrated in FIGS. 3 and 4, below.

Figure 5:
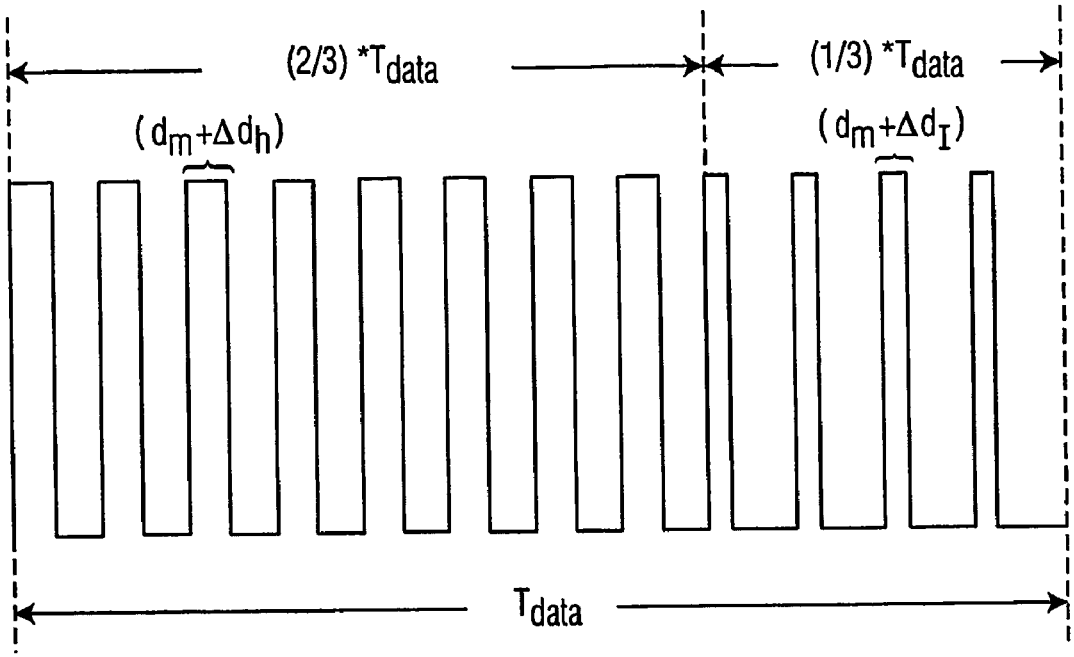
FIG. 5 is a waveform diagram illustrating an asymmetric pulse width modulated waveform, expressing a "0" bit, delivering a greater average lamp power in an embodiment of the invention.
Figure 6:
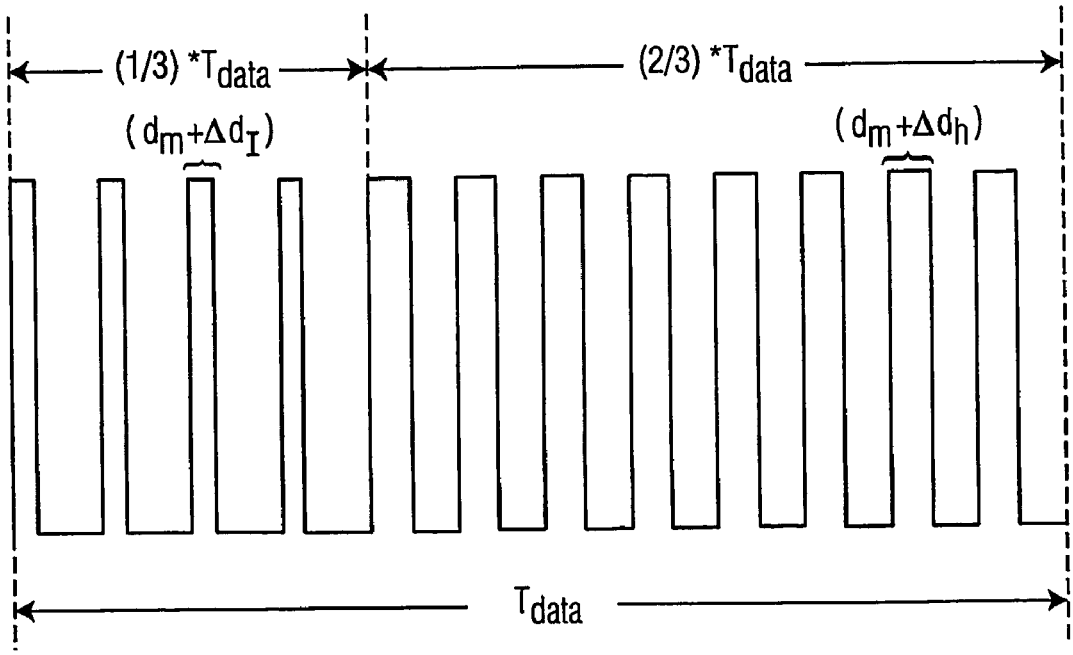
FIG. 6 is a waveform diagram illustrating an asymmetric pulse width modulated waveform, expressing a "1" bit, delivering a greater average lamp power in an embodiment of the invention.

In another example, when the average duty cycle $d_m$ and the upper portion of the duty cycle range [($d_m+\Delta d_l$) to ($d_m+\Delta d_h$)] are near the upper portion of the duty cycle spectrum (near $d_h$), an asymmetric bi-phase driving signal delivering a greater than average lamp power is produced. Such an asymmetric pulse width modulated driving signal is illustrated in FIGS. 5 and 6, below.

Figure 7:
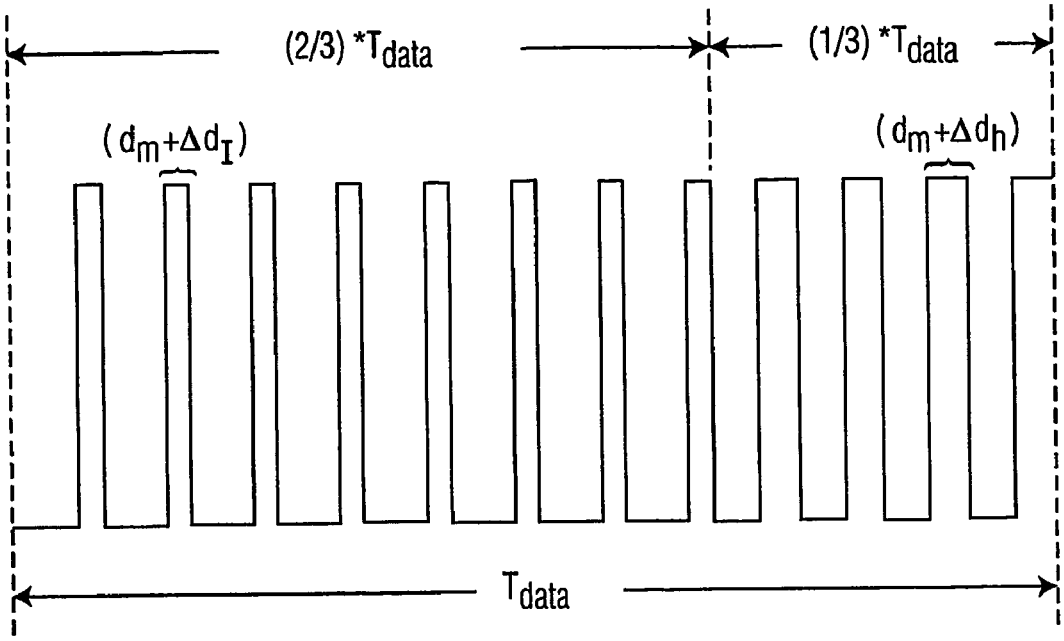
FIG. 7 is a waveform diagram illustrating an asymmetric pulse width modulated waveform, expressing a "0" bit, delivering a lesser average lamp power in an embodiment of the invention.
Figure 8:
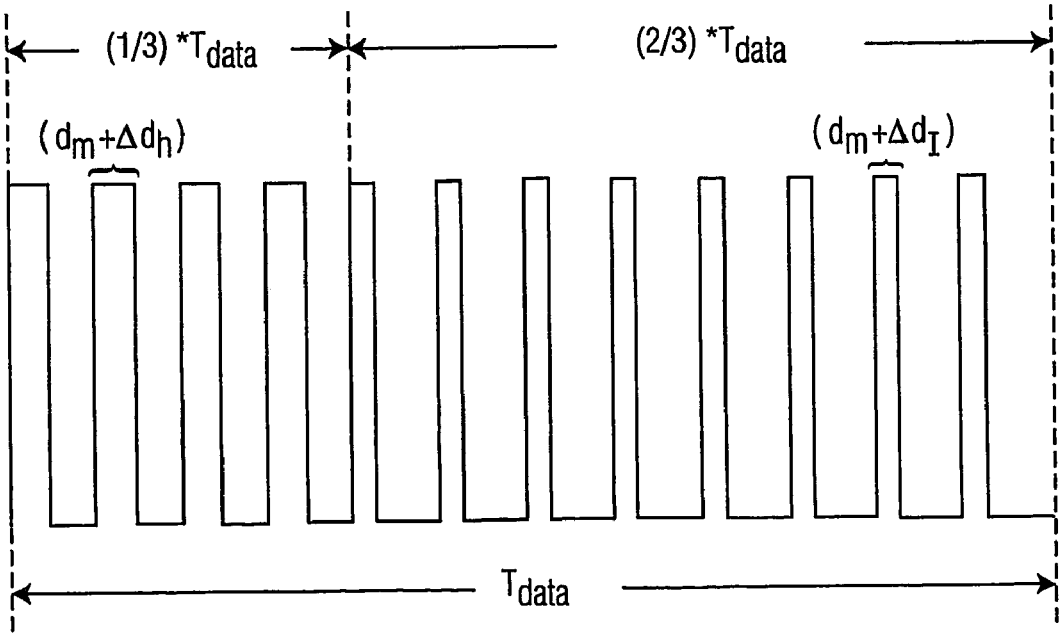
FIG. 8 is a waveform diagram illustrating an asymmetric pulse width modulated waveform, expressing a "1" bit, delivering a lesser average lamp power in an embodiment of the invention.

In yet another example, when the average duty cycle $d_m$ and the lower portion of the duty cycle range [($d_m+\Delta d_l$) to ($d_m+\Delta d_h$)] are near the lower portion of the duty cycle spectrum (near $d_l$), an asymmetric bi-phase driving signal delivering a less than average lamp power is produced. Such an asymmetric pulse width modulated driving signal is illustrated in FIGS. 7 and 8, below.

Figure 3:
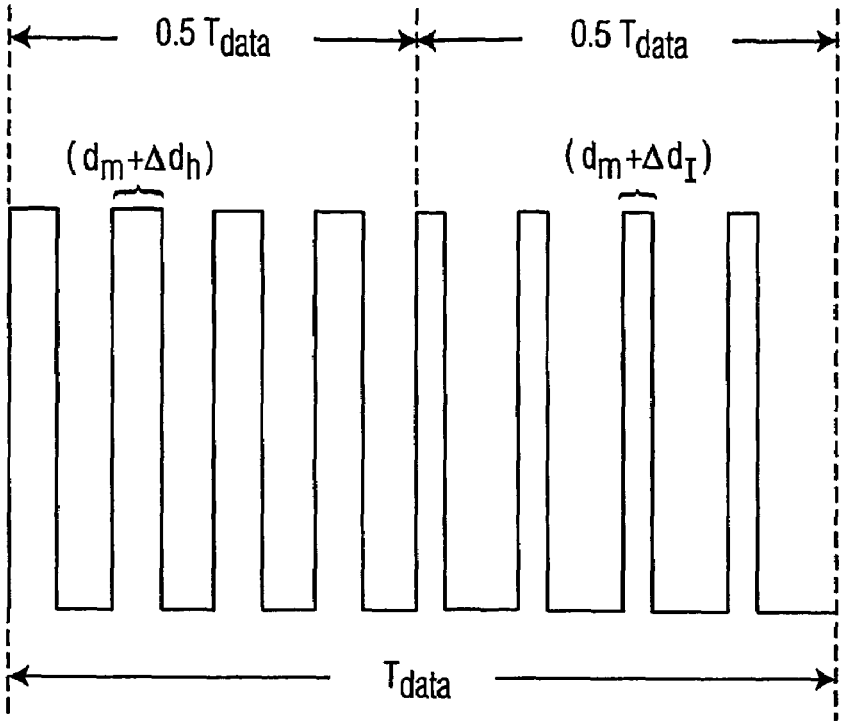
FIG. 3 is a waveform diagram illustrating a symmetric bi-phase pulse width modulated waveform, expressing a "0" bit, as may be applied in an embodiment of the invention.
Figure 4:
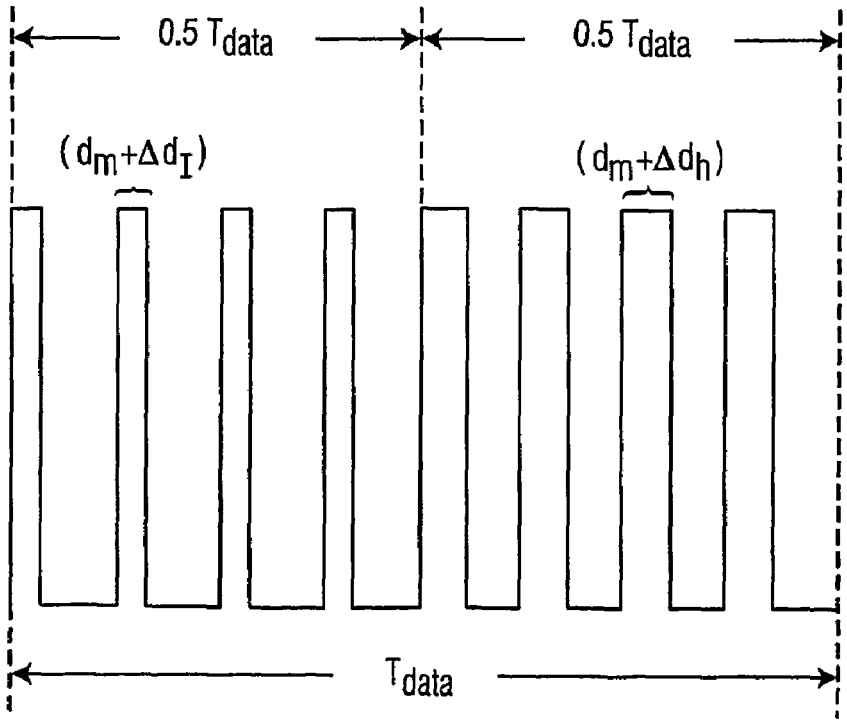
FIG. 4 is a waveform diagram illustrating a symmetric bi-phase pulse width modulated waveform, expressing a "1" bit, as may be applied in an embodiment of the invention.

FIGS. 3 and 4 are waveform diagrams illustrating symmetric bi-phase pulse width modulated waveforms as may be applied in an embodiment of the invention. The use of a symmetric pulse width modulated driving signal waveform is referred to as a symmetric coding scheme.

The symmetric coding scheme is defined by the utilization of one-half of a data period $T_{data}$ for each half "bit" portion of the waveform. In an example and referring to FIG. 3, a "0" bit is expressed by the first half of the data period $T_{data}$ including wide pulses, and the second half of the data period $T_{data}$ including narrow pulses. In this example and referring to FIG. 4, a "1" bit is expressed by the first half of the data period $T_{data}$ including narrow pulses, and the second half of the data period $T_{data}$ including wide pulses. Conversely, the symmetric coding scheme could be employed in a reverse implementation.

In one embodiment and referring to FIG. 2, the duty cycle of the wide pulses is determined by the design variable $\Delta d_h$. That is, the duty cycle of the wide pulses is equal to the value of the sum of the average duty cycle $d_m$ and the design variable $\Delta d_h$, expressed $(d_m+\Delta d_h)$, where $\Delta d_h$ is positive. In this embodiment, the duty cycle of the narrow pulses is defined by the design variable $\Delta d_l$. That is, the duty cycle of the narrow pulses is equal to the value of the sum of the average duty cycle $d_m$ and the design variable $\Delta d_l$, expressed as $(d_m+\Delta d_l)$, where $\Delta d_1$ is negative.

FIGS. 5 and 6 are waveform diagrams illustrating asymmetric bi-phase pulse width modulated waveforms as may be applied in an embodiment of the invention. The use of an asymmetric bi-phase driving signal waveform is referred to as an asymmetric coding scheme.

The asymmetric coding scheme is defined by the utilization of greater than one-half of a data period $T_{data}$ for one "bit" portion of the waveform, and utilization of less than one-half of a data period $T_{data}$ for another "bit" portion of the waveform.

In one embodiment, a "0" bit is expressed by the first portion of the data period $T_{data}$ including wide pulses, and the second portion of the data period $T_{data}$ including narrow pulses. In this embodiment, a "1" bit is expressed by the first portion of the data period $T_{data}$ including narrow pulses, and the second portion of the data period $T_{data}$ including wide pulses.

In an example and referring to FIG. 5, the "0" bit is expressed by the first portion of the data period $T_{data}$ utilizing two-thirds (⅔) of the data period $T_{data}$. Therefore, the utilized two-thirds (⅔) of the data period $T_{data}$ would include wide pulses and the remaining one-third (⅓) of the data period $T_{data}$ would include narrow pulses. In this example and referring to FIG. 6, the "1" bit is expressed by the first portion of the data period $T_{data}$ utilizing one-third (⅓) of the data period $T_{data}$. Therefore, the utilized two-thirds (⅔) of the data period $T_{data}$ would include wide pulses and the remaining one-third (⅓) of the data period $T_{data}$ would include narrow pulses.

As discussed in FIGS. 3 and 4 and referring to FIG. 2, the duty cycle of the wide pulses is determined by the design variable $\Delta d_h$. That is, the duty cycle of the wide pulses is equal to the value of the sum of the average duty cycle $d_m$ and the design variable $\Delta d_h$, expressed as $(d_m+\Delta d_h)$, where $\Delta d_h$ is positive. In this embodiment, the duty cycle of the narrow pulses is determined by the design variable $\Delta d_l$. That is, the duty cycle of the narrow pulses is equal to the value of the sum of the average duty cycle $d_m$ and the design variable $\Delta d_l$, expressed as $(d_m+\Delta d_l)$, where $\Delta d_l$ is negative.

The asymmetric coding scheme utilized in FIGS. 5 and 6 results in an increase in average lamp power. In one embodiment, the increase in average lamp power allows the sum of the average duty cycle $d_m$ and the design variable $\Delta d_h$, expressed as $(d_m+\Delta d_h)$ to operate closer to maximum duty cycle $d_{max}$. The result of the sum of the average duty cycle $d_m$ and the design variable $\Delta d_h$, expressed as $(d_m+\Delta d_h)$ operating closer to the maximum duty cycle $d_{max}$ is the movement of the maximum average duty cycle $d_h$ closer to the maximum duty cycle $d_{max}$. This asymmetric coding scheme allows for a wider range of operation for the lamp and hence the light source.

FIGS. 7 and 8 are waveform diagrams illustrating asymmetric bi-phase pulse width modulated waveforms as may be applied in an embodiment of the invention. The use of an asymmetric bi-phase driving signal waveform is referred to as an asymmetric coding scheme.

The asymmetric coding scheme is defined by the utilization of greater than one-half of a data period $T_{data}$ for one "bit" portion of the waveform, and utilization of less than one-half of a data period $T_{data}$ for another "bit" portion of the waveform.

In one embodiment, a "0" bit is expressed by the first portion of the data period $T_{data}$ including narrow pulses, and the second portion of the data period $T_{data}$ including wide pulses. In this embodiment, a "1" bit is expressed by the first portion of the data period $T_{data}$ including wide pulses, and the second portion of the data period $T_{data}$ including narrow pulses.

In an example and referring to FIG. 7, the "0" bit is expressed by the first portion of the data period $T_{data}$ utilizing two-thirds (⅔) of the data period $T_{data}$. Therefore, the utilized two-thirds (⅔) of the data period $T_{data}$ would include narrow pulses and the remaining one-third (⅓) of the data period $T_{data}$ would include wide pulses. In this example and referring to FIG. 8, the "1" bit is expressed by the first portion of the data period $T_{data}$ also utilizing one-third (⅓) of the data period $T_{data}$. Therefore, the utilized two-thirds (⅔) of the data period $T_{data}$ would include narrow pulses and the remaining one-third (⅓) of the data period $T_{data}$ would include wide pulses.

As discussed in FIGS. 3 and 4 and referring to FIG. 2, the duty cycle of the wide pulses is determined by the design variable $\Delta d_h$. That is, the duty cycle of the wide pulses is equal to the value of the sum of the average duty cycle $d_m$ and the design variable $\Delta d_h$, expressed as $(d_m+\Delta d_h)$. In this embodiment, the duty cycle of the narrow pulses is determined by the design variable $\Delta d_l$. That is, the duty cycle of the narrow pulses is equal to the value of the sum of the average duty cycle $d_m$ and the design variable $\Delta d_l$, expressed as $(d_m+\Delta d_l)$ The asymmetric coding scheme utilized in FIGS. 7 and 8 results in a decrease in average lamp power. In one embodiment, the decrease in average lamp power allows the sum of the average duty cycle $d_m$ and the design variable $\Delta d_l$, expressed as $(d_m+\Delta d_l)$ to operate closer to the minimum duty cycle $d_{min}$. The result of the sum of the average duty cycle $d_m$ and the design variable $\Delta d_l$, expressed as $(d_m+\Delta d_l)$ operating closer to the minimum duty cycle $d_{min}$ is the movement of the minimum average duty cycle $d_l$ closer to the minimum duty cycle $d_{min}$. This asymmetric coding scheme also allows for a wider range of operation for the lamp and hence the light source.

The asymmetric coding scheme, discussed in FIGS. 5-8, requires multiple pulses for implementation. A single pulse implementation will result in symmetric coding scheme utilization.

Additionally, determination of use of the asymmetric coding scheme is a design determination. In one embodiment and referring to FIG. 2, a symmetric coding scheme (detail in FIGS. 3 and 4, above) is utilized if the average duty cycle $d_m$, based on the average lamp power level $P_m$, is located between the maximum average duty cycle $d_h$ and minimum average duty cycle $d_l$ on the duty cycle range.

In this embodiment, an asymmetric coding scheme providing an increased average lamp power output (detail in FIGS. 5 and 6, above) is utilized if the average duty cycle $d_m$, based on the average lamp power level $P_m$, is located between the maximum average duty cycle $d_h$ and the maximum duty cycle $d_{max}$ of the duty cycle range. Conversely, an asymmetric coding scheme providing a decreased average lamp power output (detail in FIGS. 7 and 8, above) is utilized if the average duty cycle $d_m$, based on the average lamp power level $P_m$, is located between the minimum average duty cycle $d_l$ and the minimum duty cycle $d_{min}$ of the duty cycle range.

Figure 9:
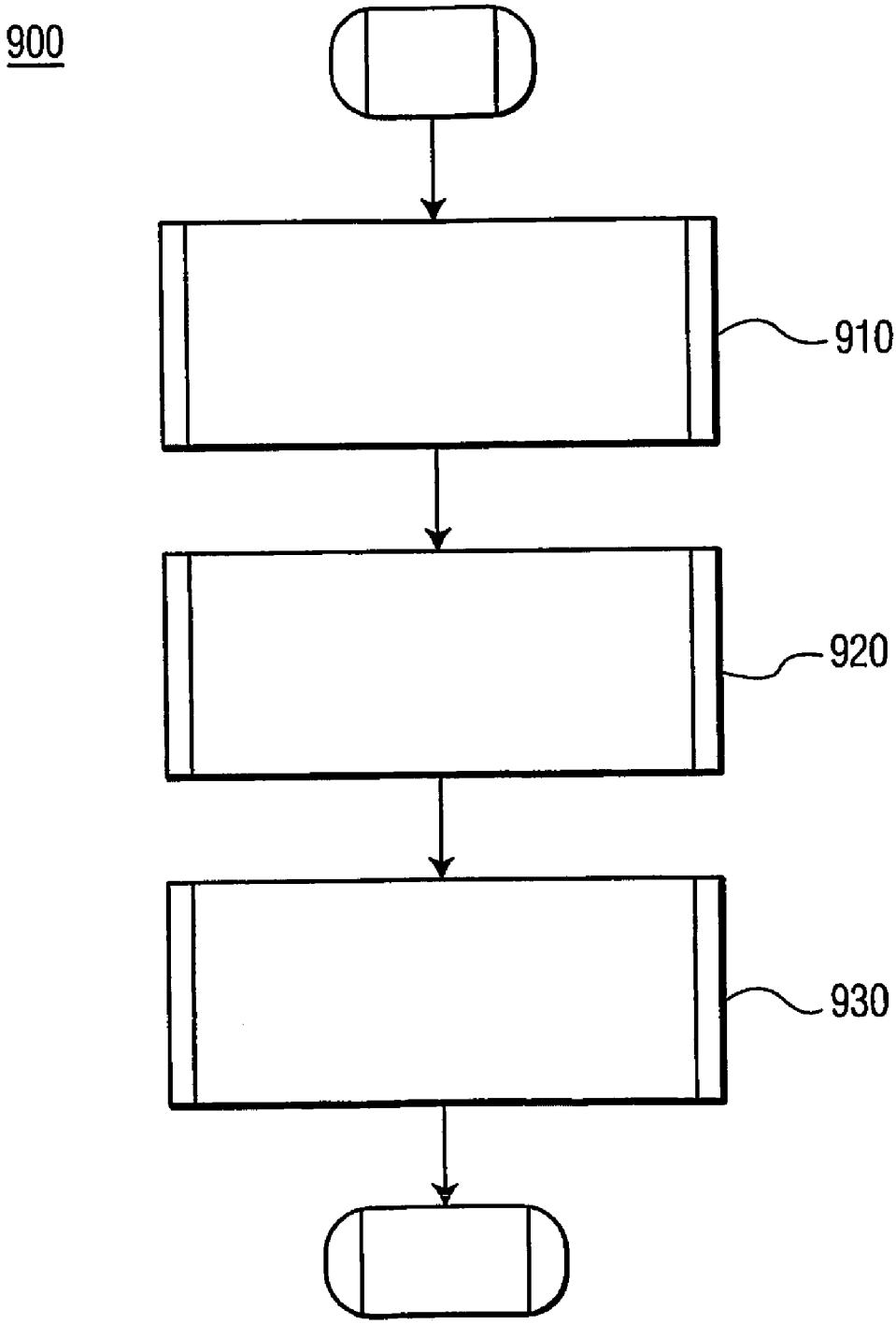
FIG. 9 is a flow diagram depicting a method of modulating a light output for data transmission in accordance with the present invention.

FIG. 9 is a flow diagram illustrating a method 900 for transmitting a data bit through a fluorescent light source during a single data period. Method 900 may utilize one or more concepts detailed in FIGS. 1-8, above.

Method 900 begins at stage 910. During stage 910, ballast 110 determines an average lamp power for application during the data period. In one embodiment, a desired lamp/light output level is received by ballast 110, and the average lamp power is determined based on the received lamp/light output level. In an example and referring to FIG. 1, microprocessor 130 of programmable digital ballast 110 includes computer code for determining the average lamp power to be applied to lamp 120 that is required to produce the desired average lamp/light output level during the data period in accordance the transfer curve illustrated in FIG. 2.

During stage 920, ballast 110 generates and communicates a pulse-width modulated (PWM) drive signal to lamp 120 during the data period. Based on either input data or a fixed code, the pulse width modulated drive signal includes either a "0" bit waveform or a "1" bit waveform for applying the average lamp power to the lamp 120 during the data period. In an example and referring to FIG. 1, microprocessor 130 of programmable digital ballast 110 includes computer code for generating the "0" bit waveform to include one or more pulses, such as, for example, the "0" bit waveforms illustrated in FIGS. 3, 5 and 7, and for generating the "1" bit waveform to include one or more pulses, such as, for example, the "1" bit waveforms illustrated in FIGS. 4, 5 and 8.

During stage 930, lamp 120 emits a modulated light output in response to a reception of the PWM drive signal during the data period. In one embodiment, the modulated light output represents the "0" data bit in response to the PWM drive signal including the "0" bit waveform. Alternatively, the modulated light output represents the "1" data bit in response to the PWM drive signal including the "1" bit waveform.

Upon completion of stage 930, ballast 110 returns to stage 910 to await a new data period.

The above-described methods and implementation utilizing light output modulation for data transmission are example methods and implementations. These methods and implementations illustrate one possible approach for utilizing light output modulation for data transmission. The actual implementation may vary from the method discussed. Moreover, various other improvements and modifications to this invention may occur to those skilled in the art, and those improvements and modifications will fall within the scope of this invention as set forth in the claims below.

The present invention may be embodied in other specific forms without departing from its essential characteristics. The described embodiments are to be considered in all respects only as illustrative and not restrictive.

The invention claimed is:

1. A method of operating a light source (100) including a ballast (110) in electrical communication with a lamp (120), said method comprising:

operating the ballast (110) to determine (920) a first average lamp power to be applied to the lamp (120) during a first data period;

operating the ballast (110) to generate and communicate (930) a first pulse width modulated drive signal to the lamp (120) during the first data period, the first pulse width modulated drive signal having one of a first waveform and a second waveform for applying the first average lamp power to the lamp (120), the first waveform including at least one pulse representative of a first data bit, the second waveform including at least one pulse representative of a second data bit; and operating the lamp (120) to emit a first modulated light output in response to a reception of the first pulse width modulated drive signal during the first data period, the first modulated light output being representative of the first data bit in response to the first pulse width modulated drive signal having the first waveform, the first modulated light output being representative of the second data bit in response to the first pulse width modulated drive signal having the second waveform.

2. The method of claim 1, further comprising:

operating the ballast (110) to determine a second average lamp power to be applied to the lamp (120) during a second data period;

operating the ballast (110) to generate and communicate a second pulse width modulated drive signal to the lamp (120) during the second data period, the second pulse width modulated drive signal having one of a third waveform and a fourth waveform for applying the second average lamp power to the lamp (120), the third waveform including at least one pulse representative of the first data bit, the fourth waveform including at least one pulse representative of the second data bit; and operating the lamp (120) to emit a second modulated light output in response to a reception of the second pulse width modulated drive signal during the second data period, the second modulated light output being representative of the first data bit in response to the second pulse width modulated drive signal having the third waveform, the second modulated light output being representative of the second data bit in response to the second pulse width modulated drive signal having the fourth waveform.

3. The method of claim 1, wherein, when the first pulse width modulated drive signal is generated as having the first waveform during the first data period, the first pulse width modulated drive signal includes a first set of at least one pulse having a first duty cycle during a first portion of the first data period and a second set of at least one pulse having a second duty cycle during a second portion of the first data period; and wherein, when the first pulse width modulated drive signal is generated as having the second waveform during the first data period, the first pulse width modulated drive signal includes the first set of at least one pulse having the first duty cycle during the second portion of the first data period and the second set of at least one pulse having the second duty cycle during the first portion of the first data period.

4. The method of claim 1, wherein, when the first pulse width modulated drive signal is generated as having the first waveform during the first data period, the first pulse width modulated drive signal includes a first set of at least one pulse having a first duty cycle during a first portion of the first data period and a second set of at least one pulse having a second duty cycle during a second portion of the first data period; and wherein, when the first pulse width modulated drive signal is generated as having the second waveform during the first data period, the first pulse width modulated drive signal includes the first set of at least one pulse having the first duty cycle during a third portion of the first data period and the second set of at least one pulse having the second duty cycle during a fourth portion of the first data period.

5. The method of claim 1, wherein, when the first pulse width modulated drive signal is generated as having the first waveform during the first data period, the first pulse width modulated drive signal includes a first set of at least one pulse having a first duty cycle during the first data period; and wherein, when the first pulse width modulated drive signal is generated as having the second waveform during the first data period, the first pulse width modulated drive signal includes a second set of at least one pulse having a second duty cycle during the first data period.

6. A light source (100), comprising:

a lamp (120);

a ballast (110) in electrical communication with said lamp (120);

wherein said ballast (110) is operable to determine a first average lamp power to be applied to said lamp (120) during a first data period, wherein said ballast (110) is operable to generate and communicate a first pulse width modulated drive signal to said lamp (120) during the first data period, the first pulse width modulated drive signal having one of a first waveform and a second waveform for applying the first average lamp power to the lamp (120), the first waveform including at least one pulse representative of a first data bit, the second waveform including at least one pulse representative of a second data bit; and wherein said lamp (120) is operable to emit a first modulated light output in response to a reception of the first pulse width modulated drive signal during the first data period, the first modulated light output being representative of the first data bit in response to the first pulse width modulated drive signal having the first waveform, the first modulated light output being representative of the second data bit in response to the first pulse width modulated drive signal having the second waveform.

7. The light source (100) of claim 6, wherein said ballast (110) is operable to determine a second average lamp power to be applied to said lamp (120) during a second data period, wherein said ballast (110) is operable to generate and communicate a second pulse width modulated drive signal to the lamp (120) during the second data period, the second pulse width modulated drive signal having one of a third waveform and a fourth waveform for applying the second average lamp power to the lamp (120), the third waveform including at least one pulse representative of the first data bit, the fourth waveform including at least one pulse representative of the second data bit; and wherein said lamp (120) is operable to emit a second modulated light output in response to a reception of the second pulse width modulated drive signal during the second data period, the second modulated light output being representative of the first data bit in response to the second pulse width modulated drive signal having the third waveform, the second modulated light output being representative of the second data bit in response to the second pulse width modulated drive signal having the fourth waveform.

8. The light source (100) of claim 6, wherein, when the first pulse width modulated drive signal is generated as having the first waveform during the first data period, the first pulse width modulated drive signal includes a first set of at least one pulse having a first duty cycle during a first portion of the first data period and a second set of at least one pulse having a second duty cycle during a second portion of the first data period; and wherein, when the first pulse width modulated drive signal is generated as having the second waveform during the first data period, the first pulse width modulated drive signal includes the first set of at least one pulse having the first duty cycle during the second portion of the first data period and the second set of at least one pulse having the second duty cycle during the first portion of the first data period.

9. The light source (100) of claim 6, wherein, when the first pulse width modulated drive signal is generated as having the first waveform during the first data period, the first pulse width modulated drive signal includes a first set of at least one pulse having a first duty cycle during a first portion of the first data period and a second set of at least one pulse having a second duty cycle during a second portion of the first data period; and wherein, when the first pulse width modulated drive signal is generated as having the second waveform during the first data period, the first pulse width modulated drive signal includes the first set of at least one pulse having the first duty cycle during a third portion of the first data period and the second set of at least one pulse having the second duty cycle during a fourth portion of the first data period.

10. The light source (100) of claim 6, wherein, when the first pulse width modulated drive signal is generated as having the first waveform during the first data period, the first pulse width modulated drive signal includes a first set of at least one pulse having a first duty cycle during the first data period; and wherein, when the first pulse width modulated drive signal is generated as having the second waveform during the first data period, the first pulse width modulated drive signal includes the first set of at least one pulse having a second duty cycle during the first data period.

11. A light source (100), comprising:

a lamp (120); and a ballast (110) in electrical communication with said lamp (120), wherein said ballast (110) includes computer readable code to determine a first average lamp power to be applied to said lamp (120) during a first data period, and computer readable code to generate and communicate a first pulse width modulated drive signal to said lamp (120) during the first data period, the first pulse width modulated drive signal having one of a first waveform and a second waveform for applying the first average lamp power to the lamp (120), the first waveform including at least one pulse representative of a first data bit, the second waveform including at least one pulse representative of a second data bit;

wherein said lamp (120) is operable to emit a first modulated light output in response to a reception of the first pulse width modulated drive signal during the first data period, the first modulated light output being representative of the first data bit in response to the first pulse width modulated drive signal having the first waveform, the first modulated light output being representative of the second data bit in response to the first pulse width modulated drive signal having the second waveform.

12. The light source (100) of claim 11, wherein said ballast (110) further includes computer readable code to determine a second average lamp power to be applied to said lamp (120) during a second data period, wherein said ballast (110) further includes computer readable code to generate and communicate a second pulse width modulated drive signal to the lamp (120) during the second data period, the second pulse width modulated drive signal having one of a third waveform and a fourth waveform for applying the second average lamp power to the lamp (120), the third waveform including at least one pulse representative of the first data bit, the fourth waveform including at least one pulse representative of the second data bit; and wherein said lamp (120) is operable to emit a second modulated light output in response to a reception of the second pulse width modulated drive signal during the second data period, the second modulated light output being representative of the first data bit in response to the second pulse width modulated drive signal having the third waveform, the second modulated light output being representative of the second data bit in response to the second pulse width modulated drive signal having the fourth waveform.

13. The light source (100) of claim 11, wherein, when the first pulse width modulated drive signal is generated as having the first waveform during the first data period, the first pulse width modulated drive signal includes a first set of at least one pulse having a first duty cycle during a first portion of the first data period and a second set of at least one pulse having a second duty cycle during a second portion of the first data period; and wherein, when the first pulse width modulated drive signal is generated as having the second waveform during the first data period, the first pulse width modulated drive signal includes the first set of at least one pulse having the first duty cycle during the second portion of the first data period and the second set of at least one pulse having the second duty cycle during the first portion of the first data period.

14. The light source (100) of claim 11, wherein, when the first pulse width modulated drive signal is generated as having the first waveform during the first data period, the first pulse width modulated drive signal includes a first set of at least one pulse having a first duty cycle during a first portion of the first data period and a second set of at least one pulse having a second duty cycle during a second portion of the first data period; and wherein, when the first pulse width modulated drive signal is generated as having the second waveform during the first data period, the first pulse width modulated drive signal includes the first set of at least one pulse having the first duty cycle during a third portion of the first data period and the second set of at least one pulse having the second duty cycle during a fourth portion of the first data period.

15. The light source (100) of claim 11, wherein, when the first pulse width modulated drive signal is generated as having the first waveform during the first data period, the first pulse width modulated drive signal includes a first set of at least one pulse having a first duty cycle during the first data period; and wherein, when the first pulse width modulated drive signal is generated as having the second waveform during the first data period, the first pulse width modulated drive signal includes the first set of at least one pulse having a second duty cycle during the first data period.

* * * * *